US010487479B2

(12) United States Patent
Marchand

(10) Patent No.: US 10,487,479 B2
(45) Date of Patent: Nov. 26, 2019

(54) DEVICE, SYSTEM AND METHOD FOR PROTECTING AN EDGE OF A BUCKET

(71) Applicant: Safe Metal, Lyons (FR)

(72) Inventor: Fabrice Marchand, Saint Galmier (FR)

(73) Assignee: SAFE METAL, Lyons (FR)

( * ) Notice: Subject to any disclaimer, the term of this patent is extended or adjusted under 35 U.S.C. 154(b) by 131 days.

(21) Appl. No.: 15/571,509

(22) PCT Filed: May 4, 2016

(86) PCT No.: PCT/EP2016/060051
§ 371 (c)(1),
(2) Date: Nov. 3, 2017

(87) PCT Pub. No.: WO2016/177807
PCT Pub. Date: Nov. 10, 2016

(65) Prior Publication Data

US 2018/0142448 A1 May 24, 2018

(30) Foreign Application Priority Data

May 5, 2015 (FR) ..... 15 54024

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01)

(58) Field of Classification Search
CPC ..... E02F 9/2808; E02F 9/2825; E02F 9/2883; E02F 9/2833; E02F 9/2841; E02F 9/28; E02F 3/40
(Continued)

(56) References Cited

U.S. PATENT DOCUMENTS 7,793,444 B2 * 9/2010 Jones ..... E02F 9/2825 37/456
8,458,931 B2 * 6/2013 Knight ..... E02F 9/2833 37/456
(Continued)

FOREIGN PATENT DOCUMENTS

AU 2014323143 B2 11/2017
WO 2005098149 A2 10/2005
(Continued)

OTHER PUBLICATIONS

French Patent Application No. 15 54024, Rapport de Recherche Préliminaire, dated Mar. 2, 2016, 2 pages.
(Continued)

*Primary Examiner* — Robert E Pezzuto
(74) *Attorney, Agent, or Firm* — Soquel Group LLC

(57) ABSTRACT

A device for protecting an edge of a bucket including a rail having a retaining notch, the device including a protective part which is designed so as to be slipped onto the rail and which includes at least one locking abutment, the device also including a shim which is designed to be mounted on the protective part so as to be inserted into the retaining notch in order to block the sliding of the protective part, the device including a locking key which is movable relative to the shim, between a first angular position, in which it allows installation and removal of the shim in the window, and a second angular position, in which the key abuts against the locking abutment and thus prevents removal of the shim.

15 Claims, 13 Drawing Sheets

(58) Field of Classification Search
USPC ..... 37/446, 452–460; 172/701.1–701.3
See application file for complete search history.

(56) References Cited

U.S. PATENT DOCUMENTS

| | | | | |
|---|---|---|---|---|
| 9,540,796 | B2 * | 1/2017 | Dallard ..... | E02F 9/2833 |
| 2005/0229442 | A1 * | 10/2005 | Jones ..... | E02F 9/2825<br>37/452 |
| 2007/0051000 | A1 | 3/2007 | Li et al. | |
| 2007/0051022 | A1 | 3/2007 | Meyers et al. | |
| 2013/0185965 | A1 * | 7/2013 | Bartolome Rodriguez ..... | E02F 9/2883<br>37/453 |
| 2014/0298692 | A1 | 10/2014 | Marchand | |

FOREIGN PATENT DOCUMENTS

| | | | |
|---|---|---|---|
| WO | 2013030335 | A1 | 3/2013 |
| WO | 2015040101 | A1 | 3/2015 |

OTHER PUBLICATIONS

PCT Application No. PCT/EP2016/060051, International Search Report, dated Jul. 4, 2017, 6 pages.

* cited by examiner

DEVICE, SYSTEM AND METHOD FOR PROTECTING AN EDGE OF A BUCKET

CROSS REFERENCE TO RELATED APPLICATIONS

This application claims priority under 35 USC § 119 of French Patent Application No. 15 54024 filed on May 5, 2015.

FIELD OF THE INVENTION

The present invention relates to a device for protecting a bucket edge, and a protection system comprising such a device. The present invention also relates to a method of protecting a bucket edge with the aid of such a protection system.

The field of application of the invention is that of public works or mine extraction machines, in particular buckets, scoops or other receptacles equipping such machines, or, more generally, any other receptacle designed to scrape, remove and/or move materials from one given location to other operating stations. In the context of public works, such machines may be in the form of, for example, a backhoe, an excavator, a backhoe loader, or any construction machine of the same type. In the context of mining extraction, this type of machine may be for example a loader, an LHD ("load-haul-dumpster") or any other machine of the same type.

BACKGROUND OF THE INVENTION

In a known manner, a bucket forms a form of tray with an access opening which is generally rectangular in shape. The edges defining the opening generally form a cutting blade, an upper blade and two lateral wings. The edges in question, and, in particular, the cutting blade, generally need to be protected by wear parts that are removably mounted to cover the edges in question. These known wear parts form for example bucket teeth, or shields. To facilitate and guide the attachment of these wear parts to the bucket, the bucket is generally equipped with adapter brackets that are welded or screwed to the bucket, wherein the wear parts are designed to be mounted on the adapter brackets.

WO 2005/098149 proposes a wear assembly for an excavation bucket. In this case, the wear part is designed to be slipped on an adapter bracket that is integral with the bucket. The wear part has an opening, which, when the wear part is assembled on the adapter bracket, opens onto a hollow form of the adapter bracket. The assembly also includes a fastening means formed by a body received in the opening of the wear part, enabling it to be housed in the opening of the adapter bracket and thus to secure the wear part to the adapter bracket.

In order to maintain the fastening means in the opening of the wear part, the fastening means in question are provided with a threaded hole which may receive a threaded rod. The end of the latter may be brought into close contact with a receiving surface of the opening of the wear part by screwing. Thus, the fastening means is fixed in the opening by jamming them through the tightening pressure of the screw.

Nevertheless, this type of assembly has certain limits. In the first place, the reliability of the jamming of the fastening means depends on the clamping force applied to the threaded rod, so that insufficient force may call into question the reliability of the assembly. Secondly, the rotation of the threaded rod requires several turns in order to perform a satisfactory tightening, which may constitute a substantial loss of time for the operator, especially in the case where many wear parts must be attached to the bucket. In addition, under the effect of vibration and abrasion caused by the materials carried in the bucket, there is a risk of loosening of the threaded rod and thus accidental disassembly of the fastening means, which is likely to cause detachment of the wear part concerned. Conversely, it may sometimes be difficult for an operator to disassemble a worn wear part, in the case where the threaded rod is particularly tight or jammed by materials accumulated during use of the bucket.

SUMMARY OF THE DESCRIPTION

Accordingly, the object of the invention is to remedy the various disadvantages mentioned above and to propose a new device for protecting a bucket edge whose mounting on the bucket is reliable, easy and fast.

For this purpose, an object of the invention is a device for protecting an edge of a bucket of a public works machine or an extraction machine, wherein the bucket comprises a rail to receive the protection device, wherein a retaining slot for the protection device is provided in the rail.

The protection device according to the invention comprises an edge protection part, which is designed to be slipped on the sliding rail along a sliding axis to form an edge protection configuration, wherein a window is provided through the protective part so that the window opens into the retaining slot in the protection configuration. The protection device according to the invention also comprises a shim which is designed to be mounted within the window in order to be housed in the retaining slot in the protection configuration in order to block the sliding of the protective part relative to the rail and thus to secure the latter to each other. According to the invention, the protection device comprises at least one locking stop arranged at the periphery of the window, wherein the protection device comprises a locking key that is movable relative to the shim about a pivot axis between a first angular position, in which it allows the assembly and disassembly of the shim in the window and a second angular position, in which the key abuts the locking stop and thus prevents disassembly of the shim.

By virtue of the invention, a locking stop is provided within the window against which the rotary key bears when in a suitable orientation. In this configuration, any risk of accidental extraction of the shim from the window is thus prevented. The abutment of these two elements against each other advantageously ensures the locking of the shim in the housing that is formed by the window and the retaining slot, without the need for clamping. On the other hand, when the key is in another orientation, it does not abut the locking stop and therefore no longer opposes the assembly or disassembly of the shim. Thus, by virtue of the invention, rotation of the key through an angle less than a full turn allows a user to effect locking or unlocking of the shim in its housing, so that the assembly and disassembly of the protection device on the rail are easy, fast and reliable.

According to other advantageous features of the invention, taken separately or in combination:

The key comprises a head projecting from the shim and in a portion of which is hollowed out a passage slot, while the remaining portion of the head forms an abutment finger, wherein the protection part comprises a notch to receive the head of the key when the shim is mounted within the window, while the receiving notch extends from an entrance neck where the section of the notch is reduced to form the locking stop, so that:

a when the key is in its first angular position, the abutment finger is oriented to traverse the entrance neck during assembly or disassembly of the shim and that when the key is in its second angular position, the abutment finger abuts the entrance neck, which thus opposes the disassembly of the shim.

The key comprises a lug which extends radially relative to the pivot axis outside the shim, wherein the protection part comprises a radial stop which forms the locking stop, wherein the radial stop is arranged in the protection part in order to extend radially with respect to the key when the shim is mounted, so that:

when the key is in the first angular position, the lug is spaced from the radial stop so that the shim may be freely disassembled, and that when the key is in the second angular position, the lug abuts the radial stop and thus opposes the disassembly of the shim.

The radial stop forms a latching notch of the lug, so that, when the shim is mounted, pivoting of the key to the second angular position allows the lug to engage in the latching notch, while pivoting the key to the first angular position releases the lug from the latching notch.

The shim comprises a travel start abutment against which the lug abuts when the key is in its first angular position to limit the angular travel of the key to the first angular position.

The key comprises a substantially cylindrical clamping cam defining a cam axis which is parallel to the pivot axis but not coaxial with the latter, so that pivoting of the key from the first angular position to the second angular position causes eccentric displacement of the cam about the pivot axis, wherein the protection part comprises a bearing surface which extends in a plane substantially orthogonal to the sliding axis, so that:

when the key is in its first angular position, the cam is spaced from the support surface and that when the key is in its second angular position and when the shim is mounted, the cam bears against the bearing surface, and the shim is accordingly pressed against the retaining slot in the direction of the sliding axis.

The key comprises a longitudinal body and a sheath made of a softer material than the longitudinal body, in which the longitudinal body is inserted integrally in rotation, wherein the shim comprises a bore that is coaxial with the pivot axis and within which the longitudinal body and its sheath may be inserted to form a pivot connection about the pivot axis for the key relative to the shim, and wherein the sheath and the bore are adjusted to oppose the pivoting of the key relative to the shim around the pivot axis.

The sheath and the bore have a substantially cylindrical complementary shape, preferably with a polygonal base, which is coaxial with the pivot axis in order to oppose the pivoting of the key relative to the shim about the pivot axis.

The sheath is bonded to the longitudinal body.

The protection part comprises a retaining groove arranged at the periphery of the window opposite the locking stop, wherein the shim comprises a retaining edge designed to be inserted into the retaining groove when the shim is so mounted that when the key is in its second angular position, the shim is retained in its mounted position within the window, on the one hand, by the locking stop and, on the other hand, by the retaining groove.

The key comprises an interaction facility for a tool, so that the key may be pivoted about the pivot axis by means of the tool via the interaction facility, wherein the protection part comprises an access opening to the interaction facility, so that the key may be pivoted via its interaction facility with the tool from outside the protection part when the shim is mounted, while the protection device preferably comprises a means of the cap or lid type for closing the access opening.

The invention also relates to a system for protecting an edge of a bucket of a public works or extraction machine, wherein the protection system comprises a protection device as defined above, and a rail to receive the protection device which is designed to be secured to the bucket, while a retaining slot of the protection device is formed in the rail.

Finally, the object of the invention is a method to protect an edge of a bucket by means of the protection system defined above and comprising the successive steps of:

a) slipping the protection part on the rail by sliding it along the sliding axis to the protection configuration of the edge, b) fitting the shim within the window, wherein the key is in its first angular position, c) rotating the key to its second angular position.

BRIEF DESCRIPTION OF THE DRAWINGS

The invention will be better understood upon reading the description which follows, given solely by way of a non-limiting and non-exhaustive example and with reference to the drawing wherein.

DETAILED DESCRIPTION

Figure 1:
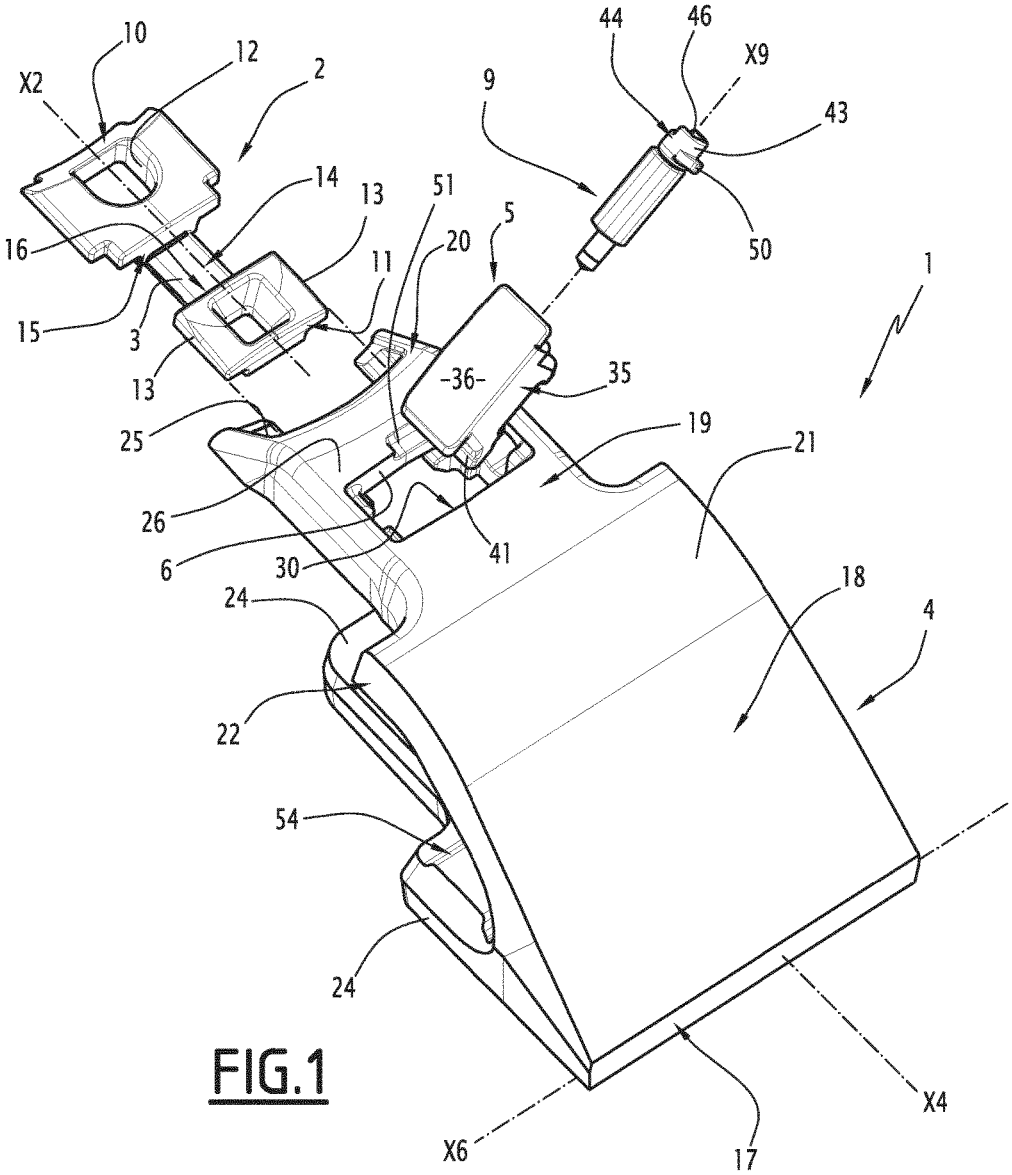
FIG. 1 shows an exploded perspective view of a protection system comprising a protection device according to the invention.

FIGS. 1 to 15 illustrate a system for protecting an edge 58 of a bucket 56 of a public works or extraction machine. The term "bucket" refers to a piece of equipment of public works machinery or mining equipment. The term "bucket" may be generalized to include scoops and other receptacles fitted on such machines, so that the term "bucket" refers to any receptacle capable of scraping, removing and/or moving materials, preferably coming from the ground, with a view to their evacuation from one given place to other operating stations. In a conventional manner, the bucket 56 forms a tray with an access opening which is, for example, of rectangular shape. The access opening is delimited by protruding edges 58, 60, 62 and 64 that the protection system of FIG. 1 is intended to protect. Among these edges, which delimit the access opening of the bucket 56, there is a cutting blade 58 which is located at the bottom of the bucket 56 and which is equipped with four teeth 65, wherein the protection system shown in FIG. 1 is intended to be mounted to protect the parts of the edge 58 which extend between two adjacent teeth.

The protection system shown in FIGS. 1 to 15 comprises a protection device 1 for the edge 58 of the bucket 56. This protection system also comprises a rail 2 for receiving the protection device 1. The rail 2, sometimes called "adapter bracket", is designed to be secured to the bucket 56 in an arrangement that allows positioning of the protection device 1 in a protection configuration of the edge 58. The rail 2 has a sliding axis X2, along which the protection device 1 may slide. The rail 2 is generally positioned on an inner face of the bucket 56, wherein the sliding axis X2 is perpendicular to the edge 58 to be protected.

The rail 2 comprises successively, along the sliding axis X2:

- a base end 10, which is intended to be oriented towards the inside of the bucket 56,
- an attachment zone 12, through which the rail 2 is intended to be secured to the bucket 56, for example by welding or by bolting,
- a retaining slot 3 of the protection device 1 which is hollowed out in the rail 2, and
- a projecting end 11.

As may be seen in FIG. 1, the rail 2 also comprises two protruding ribs 13 for sliding, which extend parallel to the sliding axis X2 and symmetrically with respect to the latter from the projecting end 11 to the retaining slot 3. The projecting end 11 of the rail 2 thus has a male dovetail shape.

The retaining slot 3 is advantageously formed by a slot base 14 which extends parallel to the sliding axis X2, and an upstream wall 15 and a downstream wall 16 which are substantially orthogonal to the sliding axis X2. The upstream wall 15 is located on the side of the end face 10, while the downstream wall 16 is located opposite the upstream wall with respect to the retaining slot 3, i.e., on the side of the protruding end 11.

The protection device 1 also comprises a part 4 for protecting the edge 58, a shim 5 and a locking key 9.

Figure 2:
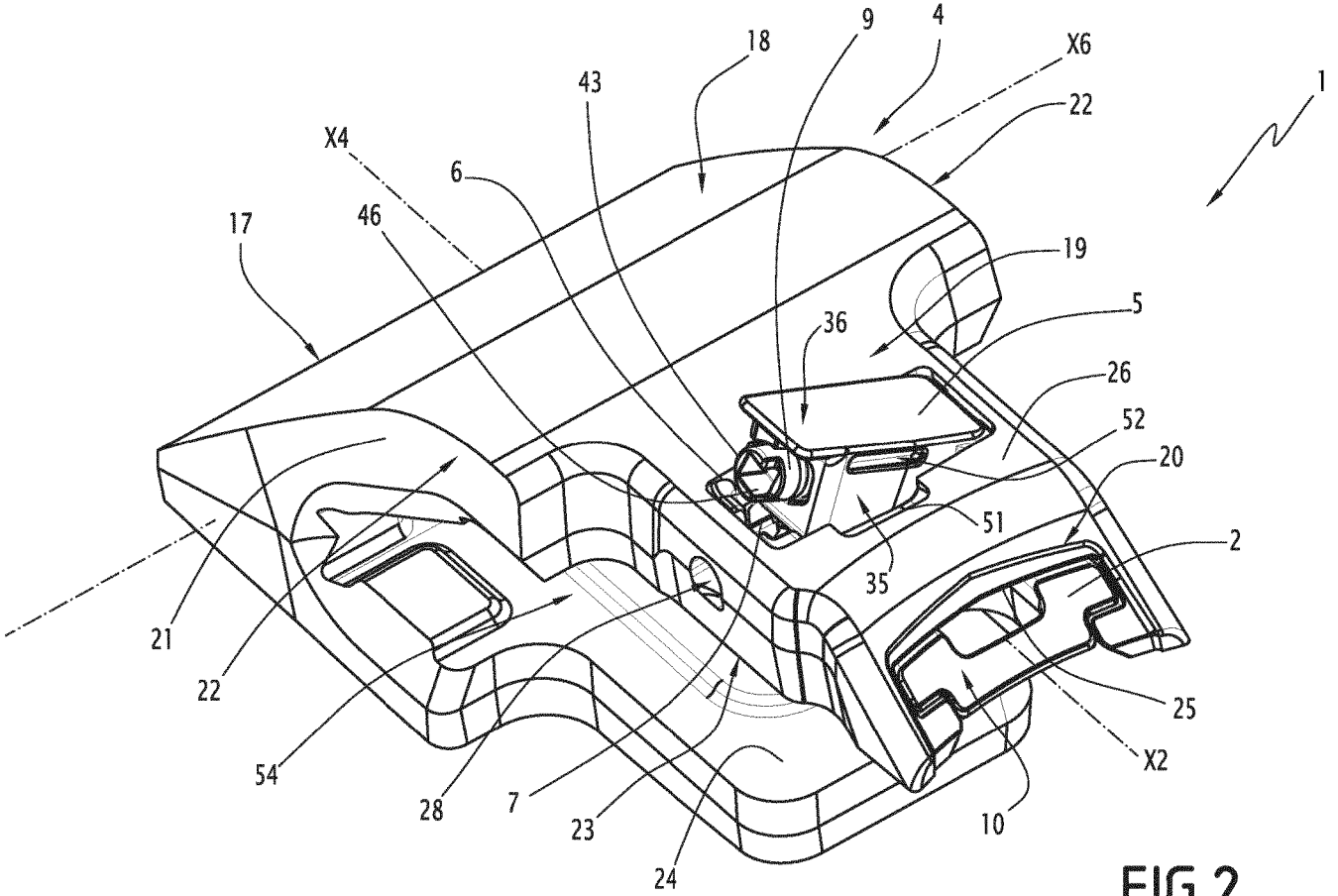
FIG. 2 shows a perspective view, from another angle, of the protection system of FIG. 1, which is shown in another configuration.
Figure 3:
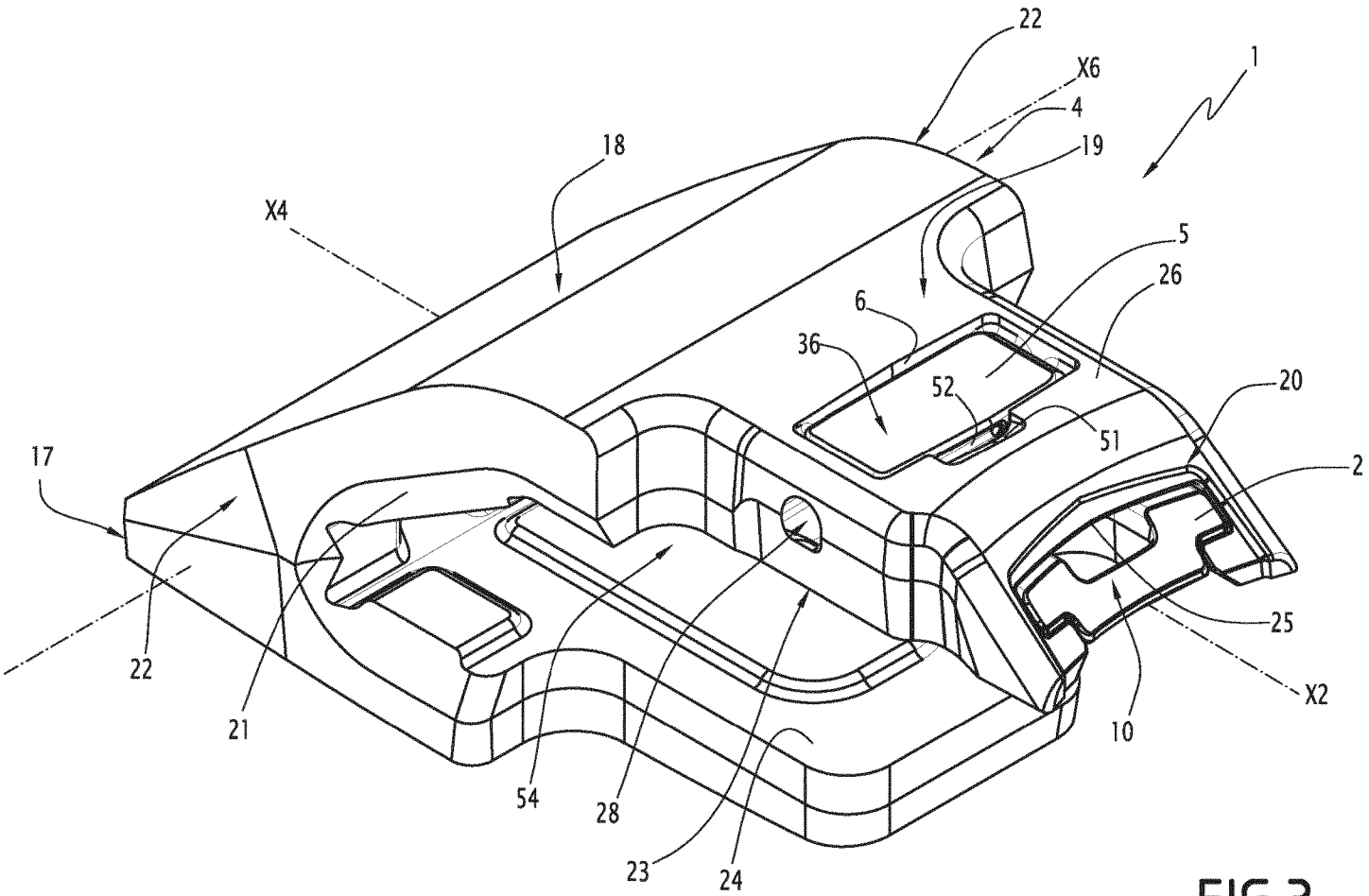
FIG. 3 shows a perspective view at the same angle as that of FIG. 2, wherein the protection system is shown in a different configuration from that of FIG. 2.

The protection part 4, which is shown in full in FIGS. 1, 2 and 3 and partly in section in FIGS. 5 to 9, forms a wear part, which may be described as a "shield" that is intended to cover and protect the edge 58 of the bucket 56. It is for example made of metal, i.e., of the steel or cast iron type.

The protection part 4 or shield extends along a longitudinal axis X4 and comprises a main body 21. A transverse axis X6 is defined which is orthogonal to the longitudinal axis X4. The main body 21 has a generally symmetrical shape with respect to a plane orthogonal to the transverse axis X6 and comprises the longitudinal axis X4.

The protection part 4 comprises successively along the longitudinal axis X4:

- a cutting edge 17 which extends parallel to the transverse axis X6,
- an upper surface 18 which extends obliquely from the cutting edge 17, with a slope diverging from the longitudinal axis X4 away from the cutting edge 17,
- a plateau surface 19 which extends in a plane parallel to the longitudinal axis X4 and to the transverse axis X6, wherein the plateau surface 19 extends the upper surface 18,
- a stern surface 20 which extends with a convergent slope towards the axis X4 from the plateau surface 19 to form the end of the protection part 4 opposite the cutting edge 17.

As illustrated in FIGS. 1 to 3, the upper surface 18, the plateau surface 19 and the stern surface 20 delimit the top of the main body 21.

The protection part 4 also comprises lateral edges 22 delimiting the main body 21 in the direction of the transverse axis X6.

The protection part 4 further comprises an inner surface 23, visible for example in FIGS. 4 to 9, wherein the inner surface 23 defines the underside of the main body 21 and extends at a distance from, and substantially parallel to, the stern surface 20 at the plateau surface 19 and the upper surface 18. Thus, the main body 21 of the protection part 4 is preferably of a generally constant thickness.

The protection part 4 finally comprises a pad 24 which is visible in particular in FIGS. 1, 2, 3 and 9. The pad 24 projects from the main body 21, i.e., from the inner surface 23 and the cutting edge 17, in a direction substantially parallel to the longitudinal axis X4. An interstitial notch 54 is thus formed between the pad 24 and the inner surface 23 of the main body 21.

The protection part 4 also comprises a sliding groove 25, which extends in the direction of the longitudinal axis X4 from the stern surface 20 and which is formed along the inner surface 23 facing the surface 19. The sliding groove 25 has a section, in a plane orthogonal to the longitudinal axis X4, with a female dovetail form that is complementary to that of the projecting end 11 of the rail 2.

A portion of the main body 21, which is delimited by the tray surface 19 and extends to the inner surface 23, forms a connecting portion 26 of the main body 21, which is shown in isolation in FIGS. 4 to 8. At this connecting portion 26, the lateral edges 22 are substantially parallel to each other and to the longitudinal axis X4. The connecting portion 26 has a width that is parallel to the transverse axis X6, and which is advantageously less than the width of the remainder of the main body 21. The pad 24 itself has a width comparable to, or equal to, the width of the connecting part 26.

The protection part 4 also comprises a window 6, which is formed through this protection part 4, in this case in the connecting portion 26 of the main body 21, in a direction orthogonal to the longitudinal axis X4 and to the transverse axis X6, starting from the plateau surface 19, so as to open at the inner surface 23 and, more particularly, in the sliding groove 25.

The window 6 preferably has a section of generally rectangular shape in a plane defined by the longitudinal axis X4 and the transverse axis X6 and extending symmetrically on either side of a plane orthogonal to the transverse axis X6 and comprising the longitudinal axis X4, wherein the length of the rectangular section of the window 6 is substantially parallel to the cutting edge 17. The window 6 thus opens, on the one hand, at the plateau surface 19, i.e., on the top of the protection part 4 and, on the other hand, in the interstitial notch 54. The window 6 is also particularly visible in FIGS. 4 and 5. It may be noted in these figures that the sliding groove 25 extends along the longitudinal axis X4 from the stern surface 20 to an end surface 27 which is located beyond the window 6, on the cutting edge 17 side.

The window 6 is delimited by two transverse walls 30 of the protection part 4, opposite and oriented parallel to the transverse axis X6. The window 6 is also delimited by two longitudinal walls 31 of the protection part 4, which are of a shorter length compared to the transverse walls 30 and which extend parallel to the longitudinal axis X4.

The protection part 4 is designed to be slipped on the sliding rail 2 along the sliding axis X2 of the rail 2.

For this, the sliding groove 25 is threaded on the rail 2 by the projecting end 11, wherein the projecting ribs 13 guide the dovetail form of the sliding groove 25. The translation of the protection part 4 along the axis X2 is made as far as a protection configuration of the edge 58, wherein the edge 58 in question is held between the inner surface 23 and the pad 24 at the bottom of the interstitial notch 54. In the protection configuration, the window 6 opens into the retaining slot 3. In particular, the upstream wall 15 and the downstream wall 16 are substantially aligned with the transverse walls 30 of the window 6. The slot base 14 is, itself, visible from the outside of the protection part 4 through the window 6.

Upon sliding the protection part 4 on the rail 2, the sliding axis X2 and the longitudinal axis X4 are superimposed. The transverse axis X6 is advantageously parallel to the edge 58 of the bucket 56. In the protection configuration, the connecting portion 26 substantially covers the entire rail 2, as may be seen in particular in FIGS. 2 and 3. The stern surface 20 lies advantageously in the extension of the surface forming the end face 10 to form a single visible surface, as may be seen in FIG. 3. Preferably, in a protection configuration, the plateau surface 19 is oriented towards the inside of the bucket 56, while the pad 24 is oriented towards the periphery of the bucket 56. Of course, the opposite situation may be considered. In this configuration, the projecting end 11 comes into contact with, or close to, the end surface 27 of the inside of the sliding groove 25, which may be seen in FIG. 5.

Figure 12:
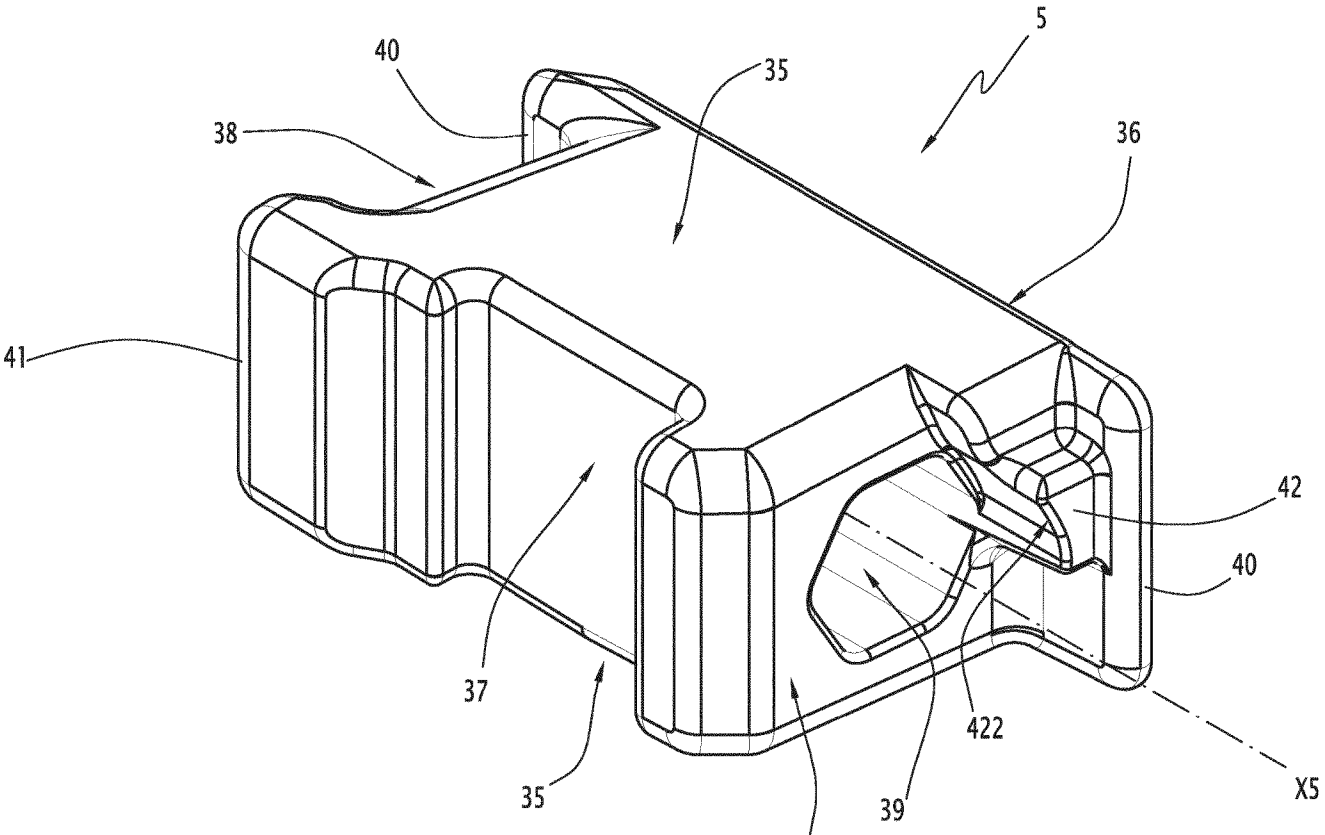
FIG. 12 shows a perspective view of the shim of the protection device of the preceding figures.

The protection device 1 also comprises a shim 5 which is shown by itself in FIG. 12, but which is also visible in FIGS. 1, 2 and 3 within the protection device 1. The shim 5 has a general parallelepiped shape and forms a shim body which extends between two opposite lateral faces 35 which are substantially parallel to each other, wherein the lateral faces 35 are interconnected by a plateau face 36 and a lower face 37, on the one hand, while, on the other hand, the plateau face 36 and the lower face 37 lie opposite and substantially parallel to each other. Finally, the shim 5 comprises two opposing and parallel end faces 38 which form the two remaining sides of the parallelogram shape of the shim 5.

The plateau face 36 advantageously extends, as shown in FIG. 12, beyond the end face 38 to form two transverse edges 40.

The shim 5 comprises a bore 39 which passes right through the shim body to open on either side of the shim body at the end faces 38. The bore 39 extends along a pivot axis X5 defined by the shim 5 with which it is coaxial. The bore 39 advantageously has a substantially cylindrical shape, in this case with a hexagonal base, wherein the hexagonal base is centered on the pivot axis X5.

The shim 5 also comprises a retaining edge 41 which projects from the shim body in the direction of the pivot axis X5, at the junction between a first end face 38 and the lower face 37. The retaining edge 41 advantageously extends over the entire length of the edge connecting the first end face 38 in question and the lower face 37.

A travel start abutment 42 is provided on the shim 5, in the form of an element projecting from the second end face 38, opposite the first end face 38, and extending from the transverse edge 40 to the edge of the bore 39. The travel start abutment 42 thus forms a wall 422 which extends in the extension of one of the hexagonally-shaped portions of the bore 39.

The shim 5 is advantageously made of a metallic material. Alternatively, it may be made of a synthetic material such as a polymer.

Figure 10:
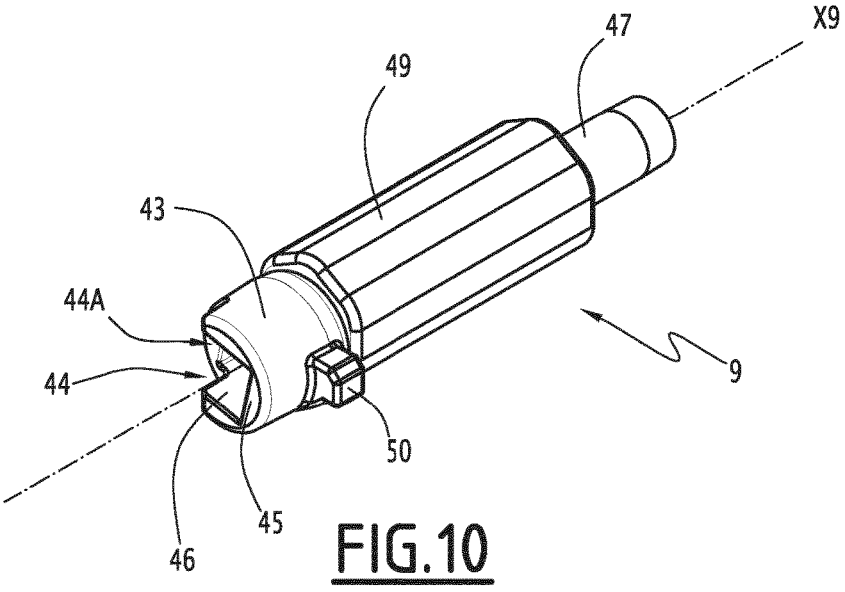
FIG. 10 shows a perspective view of the locking key of the protection device of the preceding figures.
Figure 11:
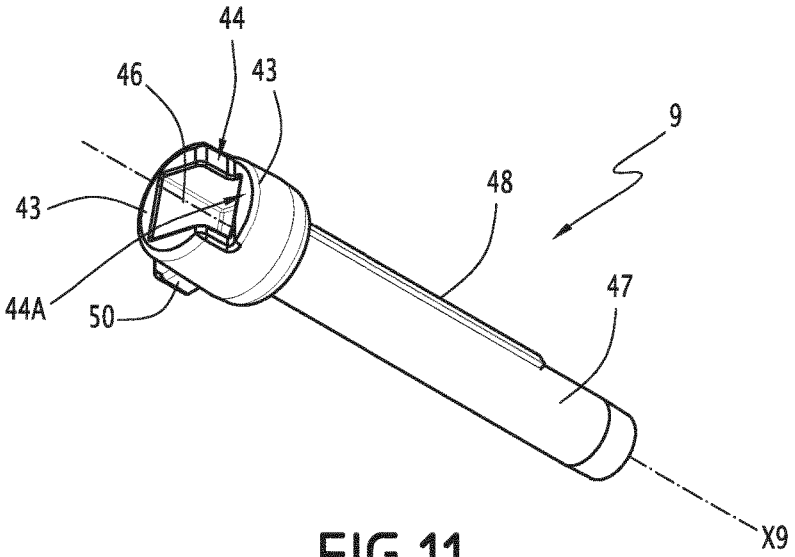
FIG. 11 shows a perspective view of a part of the locking key.

The protection device 1 also comprises a locking key 9 which is shown independently in FIGS. 10 and 11. The key 9 extends longitudinally along an axis X9. The key 9 includes a head 43 which forms a first of its ends along the axis X9. The head 43 preferably has a substantially cylindrical peripheral contour with a circular base and is coaxial with the axis X9. A passage slot 44 is hollowed out in a portion of the head 43, as may be seen in particular in FIGS. 10, 11, 13 and 14. The passage slot 44 is bordered by a surface 44A perpendicular to the axis. X9, which is formed in the head 43 and which is set back on the side of a longitudinal body 47 of the key 9, relative to the end of the head 43 opposite the body 47. The remaining portion of the head 43 then forms an abutment finger 45 which constitutes a cylinder portion coaxial with the axis X9 and forms part of the periphery of the head 43.

The key 9 includes an interaction facility 46, which is formed in the head 43. The interaction facility 46 is designed to allow the interaction of the key 9 with a tool (not shown), so that the key 9 may be rotated about the axis X9 with the aid of the tool via the interaction facility 46.

The longitudinal body 47 extends along the axis X9 from the head 43. The longitudinal body 47 has a generally cylindrical shape coaxial with the axis X9. The longitudinal body 47 has a protruding rib 48 which extends radially with respect to the longitudinal body 47 and parallel to the axis X9. The longitudinal body 47 is preferably made of a metallic material.

The key 9 further comprises a sheath 49 which appears in FIG. 10 but which is omitted in FIG. 11. The sheath 49 is preferably made of a flexible material. By "flexible material" is meant that the sheath 49 is made of a material which is more flexible than that of the longitudinal body 47, wherein this flexible material is, for example, an elastomer. The sheath 49 forms a sheath within which the longitudinal body 47 is integrally inserted in rotation about the axis X9. The connection between the longitudinal body 47 and the sheath 49 is obtained by the presence of a longitudinal groove (not shown), which is formed in the sheath 49 and which receives the rib 48, so that a relative rotation of the sheath 49 relative to the longitudinal body 47 is prevented. Together with, or independently of, this arrangement, the sheath 49 is bonded to the longitudinal body 47, in particular glued or welded thereto.

The sheath 49 has a substantially cylindrical shape, preferably with a hexagonal base, wherein the base is centered on the axis X9 or an axis parallel to the axis X9.

Preferably, the key 9 comprises a lug 50, which is visible in FIGS. 7 and 8, and 10-14. The lug 50 extends radially outwards with respect to the axis X9 and forms, in particular, projection of the head 43.

Figure 13:
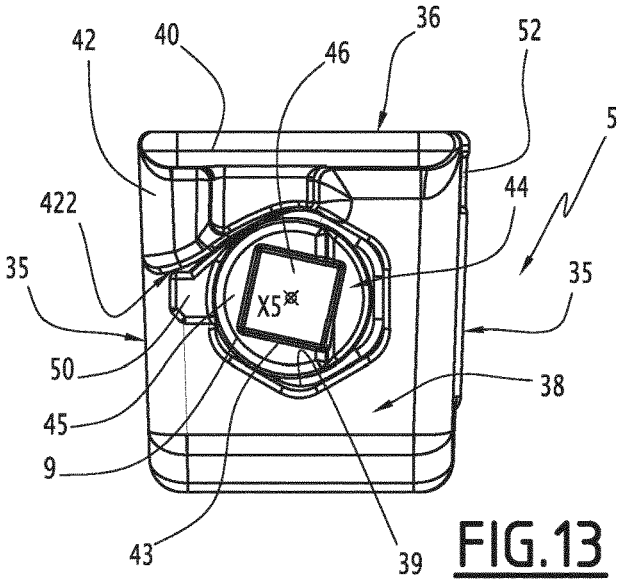
FIGS. 13 and 14 show front views of the locking key mounted on the shim, wherein the locking key is shown in two different angular positions.
Figure 14:
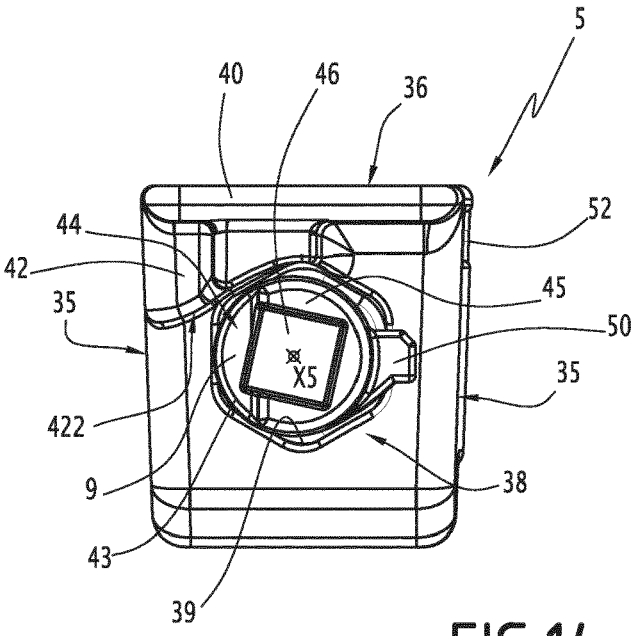

As may be seen in FIGS. 13 and 14, the key 9 is mounted to be movable relative to the shim 5 about the pivot axis X5 to be then coaxial with the axis X9 of the screw 9 and the sheath 49. In fact, the longitudinal body 47 and the sheath 49 are inserted into the bore 39 in order to create a strong pivot connection of the key 9 relative to the shim 5. For this, the sheath 49 and the bore 39 have complementary forms, in this case hexagonal, wherein these forms are coaxial with the pivot axis X5 in order to oppose the pivoting of the key 9 relative to the shim 5 about the pivot axis X5. Ultimately, the sheath 49 and the bore 39 are adjusted to oppose, for example by friction and/or complementarity of forms, the pivoting of the key 9 relative to the shim 5 about the pivot axis X5.

Alternatively, the shape of the bore 39 and the sheath 49 may be cylindrical with a circular base, wherein the sheath 49 is then tightly mounted in the bore 39 to obtain a similar result. Nevertheless, the complementary polygonal shapes which give better results are preferred.

The head 43 projects out of the shim 5, as shown in FIGS. 2, 6, 13 and 14. In this case, the head 43 projects from the second end face 38 which includes the travel start abutment 42.

The pivoting of the key 9 takes place between a first angular position which is shown in FIG. 13 and a second angular position which is shown in FIG. 14. The lug 50 is intended to abut the travel start abutment 42 when the key 9 is in its first angular position, as shown in FIG. 13, which limits the angular travel of the key 9 about the axes X5 and X9, so that it does not extend beyond the first angular position. As shown by the comparison of FIGS. 13 and 14, the angular difference between the first angular position and the second angular position is about 180°, i.e., a half-turn. Alternatively, it may be provided that the key 9 has a greater angular movement, for example three quarters of a turn, or less, for example a quarter of a turn.

The shim 5, equipped with the key 9, is designed to be mounted within the window 6. The steps to mount the shim 5 are shown in FIGS. 1, 2 and 3. The shim 5 is mounted within the window 6 in the protection configuration, in order to be housed simultaneously in the window 6 and in the retaining slot 3, which makes it possible to prevent the sliding of the protection part 4 relative to the rail 2 and thus to secure the latter with respect to each other. In practice, the shim 5 locks in the manner of a pin, the translation of the protection part 4 along the sliding axis X2, wherein the upstream wall 15 and downstream wall 16 abut the lateral faces 35 of the shim 5. The lateral faces 35 of the shim 5 preferably also abut the peripheral edge of the window 6 and, in particular, at least one of the two transverse walls 30, or both.

Figure 5:
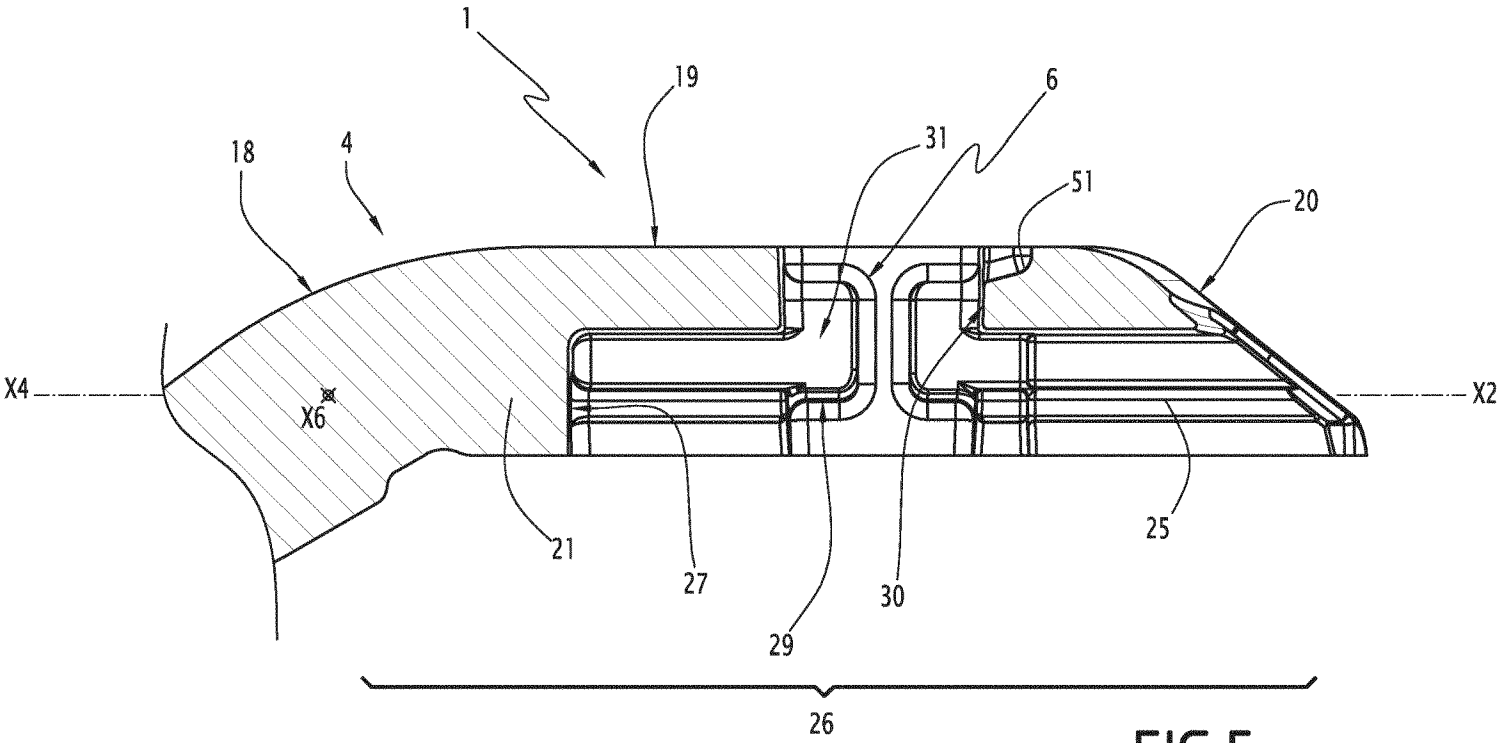
FIG. 5 shows a partial longitudinal section of the protection part of FIG. 4 along the line V-V in FIG. 9.
Figure 9:
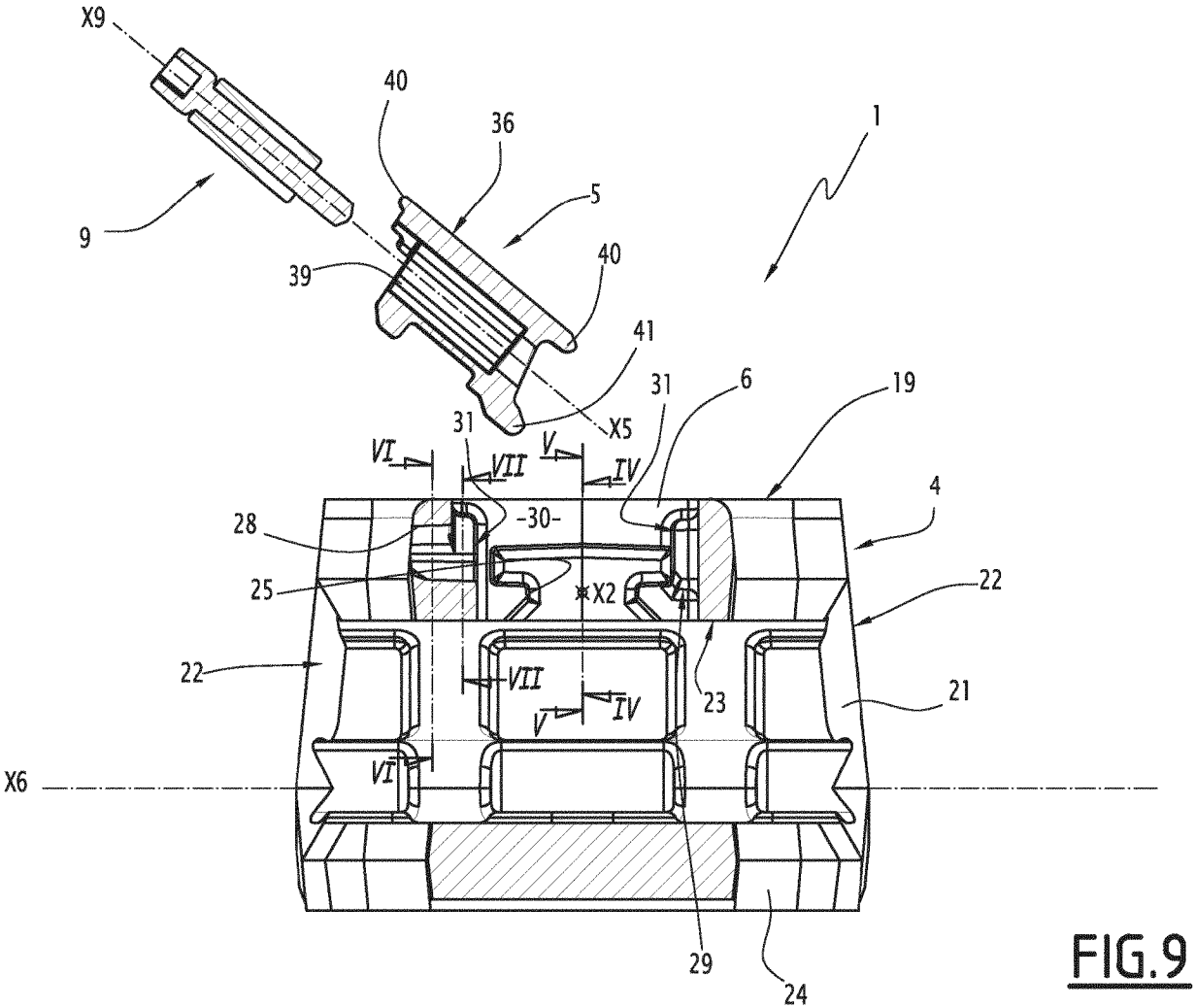
FIG. 9 shows a cross-section along a line IX-IX in FIG. 4, wherein the protection system of the preceding figures and the abovementioned section lines IV-IV, V-V, VI-VI and VII-VII are also shown.

The shim 5 is designed to be inserted into the angled window 6, i.e., inclined, so that its retaining edge 41 may be inserted first in the window 6. As illustrated in FIGS. 5 and 9, the protection part 4 comprises a retaining groove 29 which is formed in one of the longitudinal walls 31. The retaining groove 29 is thus arranged at the periphery of the window 6 and is arranged in the direction of the longitudinal axis X4 away from the inner surface 23.

The retaining edge 41 is, in this case, designed to be inserted into the retaining groove 29 during assembly of the shim 5. As shown in FIG. 2, the shim is first positioned obliquely with respect to the X4 and X6 axes, wherein its retaining edge 41 forms a guide to pivot the shim 5 about an axis parallel to the longitudinal axis X4. The shim 5 may then be tilted until the plateau face 36 lies in the extension of the plateau surface 19 as shown in FIG. 3. The transverse edges 40 extending the plateau face 36 of the shim 5 allow the coverage of most, if not all, of the upper surface of the window 6, so that the latter is completely closed, or even sealed. According to this design, the retaining notch 3 and the window 6 are protected by the shim 5 from any material coming from outside the protection device 1.

Preferably, the shim 5 rests on the slot base 14 via its lower face 37. Alternatively, the lower face 37 may be placed at a distance from the slot base 14 so that the shim 5 rests on the protection part 4 through the transverse edges 40.

The window 6 is preferably provided with a groove 51 formed at its periphery and opening on the plateau surface 19 to allow the insertion of a flat screwdriver-type tool to allow the extraction, i.e., the disassembly, of the shim 5 from the window 6, as is particularly visible in FIGS. 2 and 3. The shim 5 is provided on one of its side faces 35, which is opposite the groove 51, a corresponding recessed facility 52, allowing the insertion of the tool to allow the disassembly of the shim 5. The shim 5 may be removed from the window 6 through a tilting movement about the retaining edge 41 opposite to that which was used to mount the shim 5.

The protection part 4 advantageously comprises an access opening 28, which is visible in FIGS. 2-4 and 9. This access opening 28 is directed parallel to the transverse axis X6, starting from one of the side edges 22 and opens into the window 6. The access opening 28 is thus formed transversely in the thickness of the connecting portion 26 to connect one of the side edges 22 to the window 6. The access opening 28 opens, in this case, at one of the longitudinal walls 31 which is located opposite the longitudinal wall 31 in which the retaining groove 29 is formed. Thus, when the shim 5 is mounted within the window 6, the interaction facility 46 which makes it possible to pivot the key 9 about the pivot axis X5, is accessible from outside the protection part 4 by using a tool, wherein the tool in question may be passed through the access opening 28. This is because, when the shim 5 is mounted within the window 6, the access opening 28 is aligned, substantially coaxially, with the pivot axis X5 of the key 9. When the shim 5 is mounted in the protection part 4, the pivot axis X5 is substantially parallel to the transverse axis X6.

The access opening 28 preferably forms a bore with a substantially circular or oblong section. Preferably, the protection device 1 comprises a means of the cap or lid type for closing off the access opening 28, which is not shown in the figures, and which may be attached to the access opening 28 at the side edge 22 to cover the latter substantially sealingly, in particular to prevent any admission of undesirable materials through the window 6 via the access opening 28.

Figure 4:
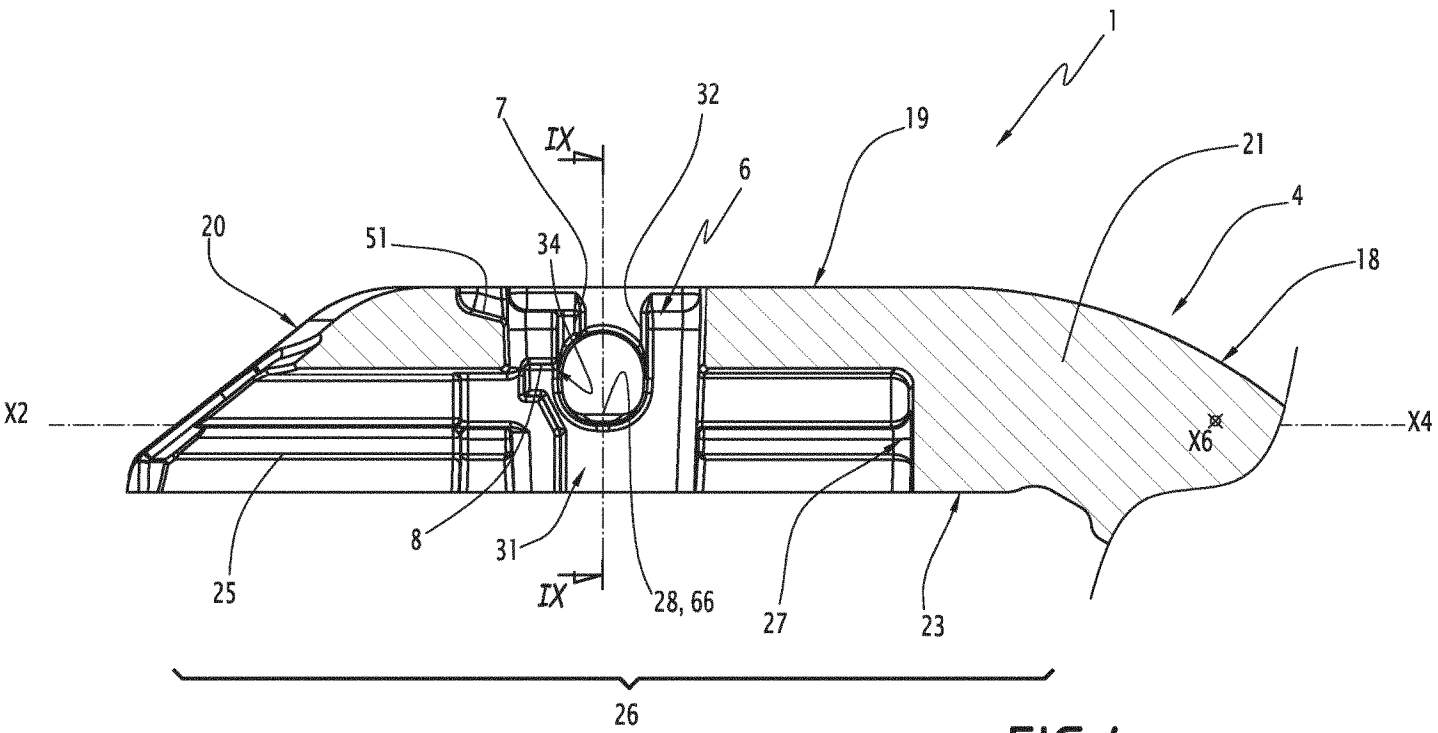
FIG. 4 shows a partial longitudinal section along the line IV-IV in FIG. 9 of a protection part belonging to the protection device of FIGS. 1, 2 and 3.
Figure 6:
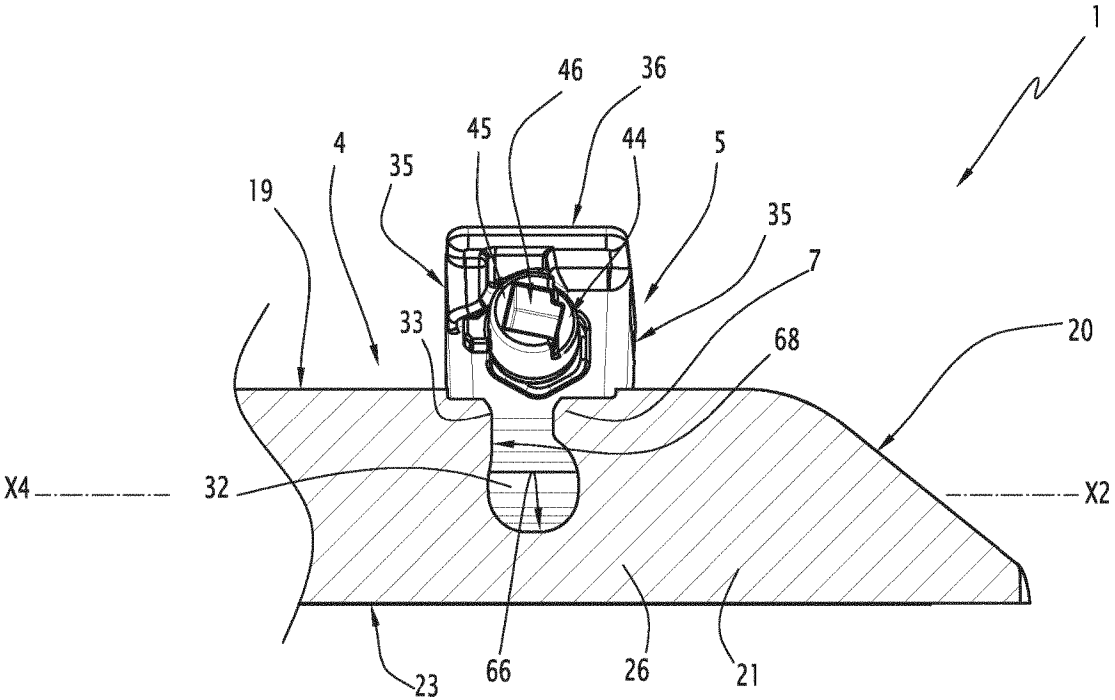
FIG. 6 shows a partial longitudinal section of an opening in the protection device of the preceding figures, along a line VI-VI in FIG. 9, before introduction of the shim in the window.

As may be seen in FIGS. 4 and 6, the protection part 4 comprises a receiving notch 32, wherein the receiving notch 32 is formed in the longitudinal wall 31 into which the access opening 28 opens and extends to an entrance neck 33, at the plateau surface 19, towards the inner surface 23. At the inlet neck 33, the section of the receiving notch 32 is reduced, in order to form a locking stop 7. The receiving notch 32 extends to a bottom of the notch 66 with a rounded shape which substantially follows the contour of the access opening 28, as is visible in particular in FIG. 4. The receiving notch 32 thus has a substantially circular shape between the entrance neck 33 and the bottom 66. The locking stop 7 is, in practice, formed by a cusp which projects parallel to the longitudinal axis X4 in the direction of the interior of the notch 32 at the entrance neck 33, i.e., in the direction of the cutting edge 17. As is shown in the figures, the upper part of the cusp or abutment 7 extends parallel to the plateau surface 19, while the lower part of the cusp has a cylindrical shape which is in line with the bottom of the notch 66 in order to extend the access opening 28 over more than half of its circumference in the direction of the inside of the window 6.

In FIG. 6, the key 9 is shown in its first angular position, while its lug 50 is in contact with the travel start abutment 42. The shim 5 is shown in the same position as in FIG. 2, i.e., during mounting, obliquely. In this configuration, it is understood that the abutment finger 45 is in alignment with the retaining groove 29, so that it may pass between the cusp forming the locking stop 7 and the other side of the entrance neck 33. At the same time, the passage slot 44 is oriented to the cusp forming the locking stop 7. The passage slot 44 is set back relative to the entrance neck 33, so that the key 9 may traverse the latter. The receiving notch 32 thus makes it possible to receive the head 43 when the shim 5 is mounted within the window 6 and when the key 9 is in its first angular position shown in FIG. 6, wherein the abutment finger 45 is oriented to traverse the entrance neck 33 during assembly or disassembly of the shim 5.

When, on the other hand, the key 9 is in its second angular position shown in FIG. 14, the abutment finger 45 abuts the cusp forming the locking stop 7 and thus abuts the entrance neck 33. In this way, the entrance neck 33 opposes the disassembly of the shim 5 by holding the key 9 within the receiving notch 32 by means of the abutment finger 45. In practice, the entrance neck 33 also opposes the mounting of the shim 5 by preventing the key 9 from being admitted into the receiving notch 32 by blocking its abutment finger 45 at the cusp forming the locking stop 7. It will be understood that the locking stop 7 interacts with the key to allow locking or unlocking of the shim 5 within the window 6, depending on the orientation of the key 9 with respect to the pivot axis X5.

Figure 7:
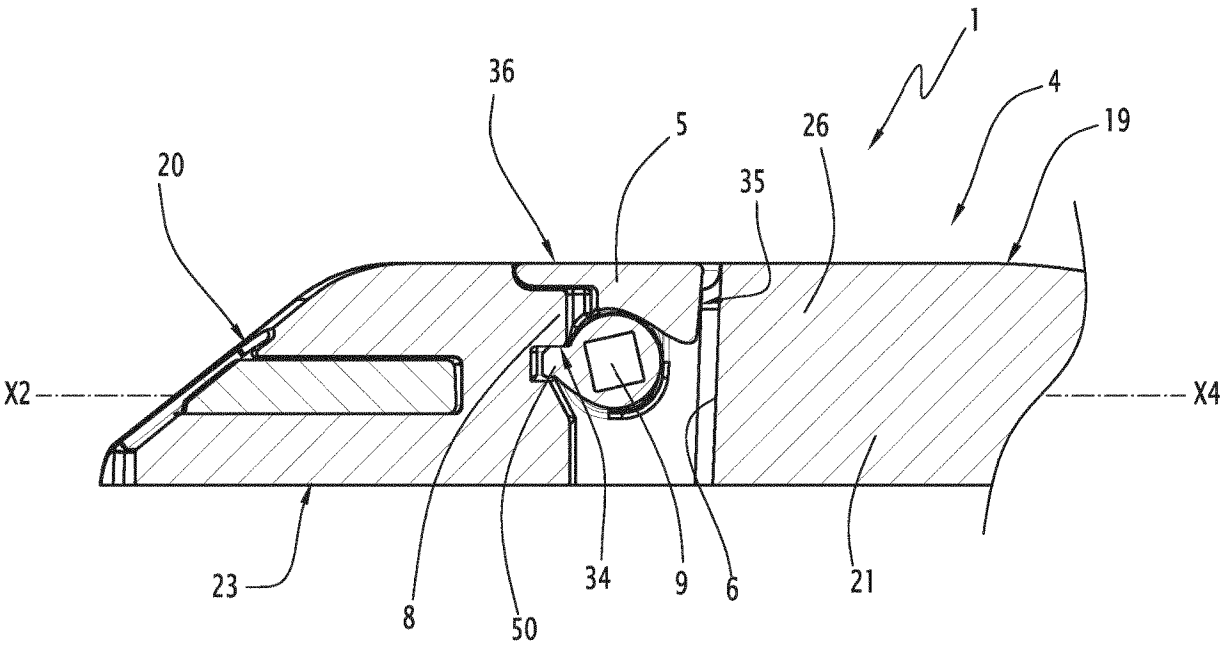
FIGS. 7 and 8 show partial longitudinal sections of an opening in the protection device, along a line VII-VII in FIG. 9, and which is shown respectively in different configurations.
Figure 8:
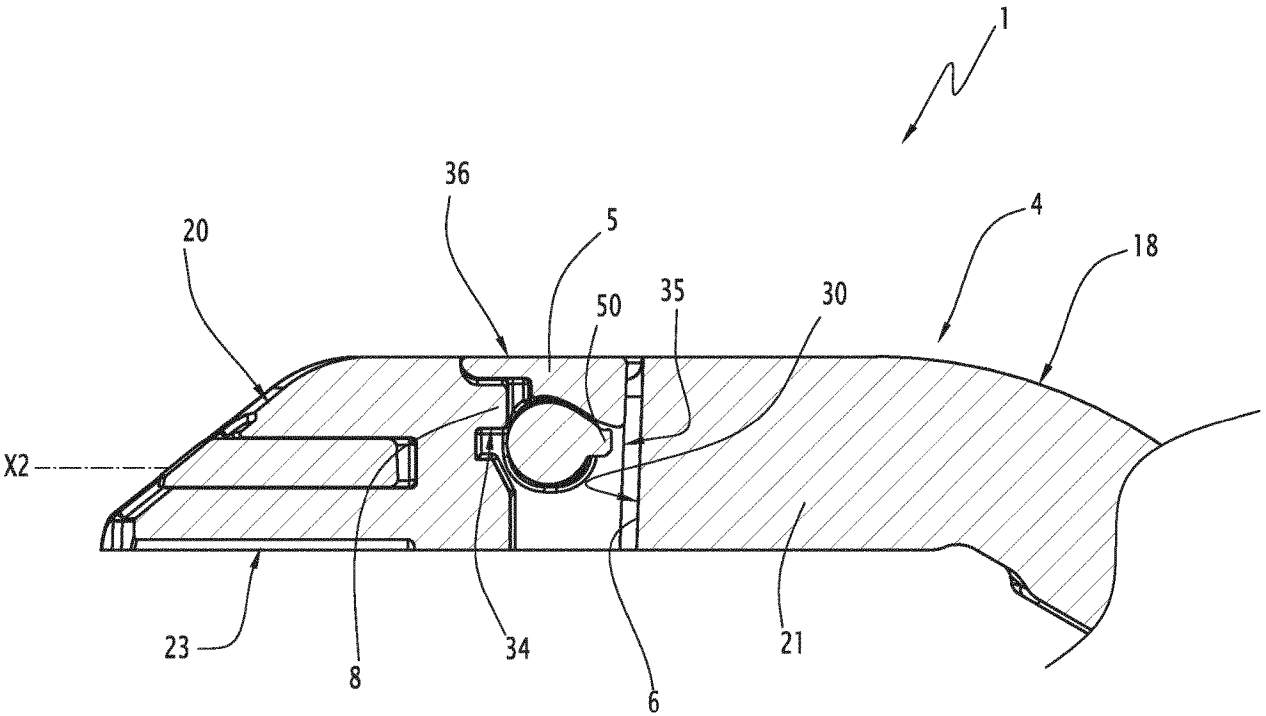

As may be seen in FIGS. 7 and 8, the protection part 4 comprises a radial stop 34 which forms another locking stop 8. The radial stop 34 is preferably formed in the longitudinal wall 31, i.e., at the periphery of the window 6 to form a wall projecting from the longitudinal wall 31. The radial stop 34 protrudes from the longitudinal wall 31 at which the access opening 28 opens. The radial stop extends radially with respect to the axis of the access opening 28, or in a plane parallel to a radius extending from the axis of the access opening 28. The radial stop 34 is thus parallel to the longitudinal axis X4 and forms a low wall which is turned towards the inner surface 23. The radial stop 34 forms a notch, and, in particular, a locking notch, and has two walls which are parallel to the longitudinal axis X4, or to a radius of the axis of the access opening 28. Such a design is particularly visible in FIGS. 4, 7 and 8.

As shown in FIGS. 7 and 8, the lug 50 extends radially with respect to the pivot axis X5 and outside the shim 5, wherein, in this case, it projects from the second end face 38. The radial stop 34 is then positioned in the protection part 4 in order to extend radially with respect to the key 9 when the shim 5 is mounted within the window 6. This arrangement is particularly visible in FIG. 8. When the key is in its first angular position as shown in FIG. 8, the lug 50 is spaced away from the radial stop 34; in this case, it is oriented in opposition to the radial stop. In this way, the shim 5 may be freely disassembled. In addition, the lug 50 does not oppose, in this first angular position, the mounting of the shim 5 within the window 6. On the other hand, when the key 9 is in its second angular position as shown in FIG. 7, the lug 50 abuts the radial stop 34, and thus opposes the disassembly of the shim 5. It will be understood that, in the second angular position, the lug 50 also prevents the shim 5 from being mounted within the window 6. In the embodiment shown in FIGS. 7 and 8, the radial stop 34 forms a snap-in notch for the lug 50, wherein these two elements have complementary shapes. The term "snap-in" is understood to mean that the lug 50 may be inserted into the notch only under the action of a force sufficient to slightly and temporarily deform the lug 50 so that it returns into the notch. An equivalent or different force must then be applied to extract the lug 50 from the snap-in notch. The interaction of the lug 50 and the snap-in notch is in the form of a non-return means that prevent the passage of the key 9 from its second angular position to its first angular position. In summary, when the shim 5 is mounted, a pivoting of the key 9 to the second angular position allows engagement of the lug 50 in the snap-in notch and a pivoting of the key to the first angular position allows the release the lug 50 from the snap-in notch.

In the example of the figures and as shown in FIG. 4, the two locking stops 7 and 8 described above and shown separately in FIG. 6, on the one hand, and in FIGS. 7 and 8, on the other hand, are implemented. Alternatively, they may nevertheless be implemented independently of one another. In other words, the protection device may include only one of these abutments.

In any event, the locking stop 7 and/or 8 is arranged at the periphery of the window 6 and, in particular, at the longitudinal wall 31 into which the access opening 28 opens.

Whatever the embodiment or variant of the locking stop 7 and/or 8, when the key 9 is in its first angular position, it allows the assembly and disassembly of the shim 5 within the window 6. When the key 9 is in its second angular position, it then abuts the locking stop 7 and/or 8, thereby preventing disassembly of the shim 5.

When the key 9 is in its second angular position, the shim 5 is retained in its mounted position within the window 6, on the one hand, by the locking stop 7 and/or 8, and, on the other hand, by the retaining groove 29, which is arranged opposite the window 6 relative to the locking stop 7 and/or 8 and which acts on the retaining edge 41 of the shim 5. As a result, the mounting of the shim 5 is particularly reliable, accurate, fast and easy to effect.

In order to further reinforce the locking of the shim 5 within the window 6 and/or the rigidity of the connection between the rail 2 and the protection part 4, it is possible to provide a means for tensioning the shim 5, on the one hand, within the window 6, or, on the other hand, within the retaining slot 3.

Thus, preferably, one of the edges of the receiving notch 32 forms a bearing surface 68 for the protection part 4. This bearing surface 68 extends in a plane substantially orthogonal to the longitudinal axis X4.

The cylindrical periphery of the head 43 of the key 9 in turn forms a clamping cam of substantially cylindrical shape. The head 42 defines a cam axis, represented by the axis X9, wherein the cam axis is then parallel to, but not coaxial with, the axis of the sheath 49, i.e., with the pivot axis X5.

Thus, the pivoting of the key 9 from the first angular position to the second angular position causes an eccentric displacement of the clamping cam, i.e., movement of the head 43 about the pivot axis X5. In this case, the eccentric displacement is carried out parallel to the longitudinal axis X4. The bearing surface 68 of the protection part 4, which is, in this case, formed by the receiving notch 32, acts as a fulcrum of the clamping cam formed by the head 43. Therefore, when the key 9 is in its first angular position, the cam is spaced away from the bearing surface 68. On the other hand, when the key 9 is in its second angular position and when the shim 5 is mounted, the cam comes into abutment with the bearing surface 68, i.e., the head 43 bears against one of the edges of the receiving notch 32, so that the shim 5 is pressed against the retaining slot 3 in the direction of the sliding axis X2. Such a design, which is not shown in the figures, makes it possible to press one of the lateral faces 35 either against the upstream wall 15 or against the downstream wall 16 of the retaining slot 3, which makes it possible to reduce or even eliminate the axial play of the connection between the protection part 4 and the rail 2.

In view of the foregoing, it is possible to summarize the arrangement for protecting the edge 58 of the bucket 56. According to a protection method, the following steps are successively implemented:

a) slipping the protection part 4 on the rail 2 by sliding the protection part 4 along the sliding axis X2 to the protection configuration of the edge 58 described above, b) mounting the shim 5 within the window 6, while the key 9 is in its first angular position and allows such mounting, c) rotating the key 9 to its second angular position to lock the mounting of the shim 5 within the window 6, and, finally, to lock the assembly of the protection system.

To disassemble this protection system, the key 9 is pivoted from its second angular position to its first angular position. Then, with the help of a tool, such as a flat screwdriver, the shim 5 is raised in order to extract it from the window 6. Finally, the protection part 4 is translated along the rail 2 until the protection part 4 is released.

Figure 15:
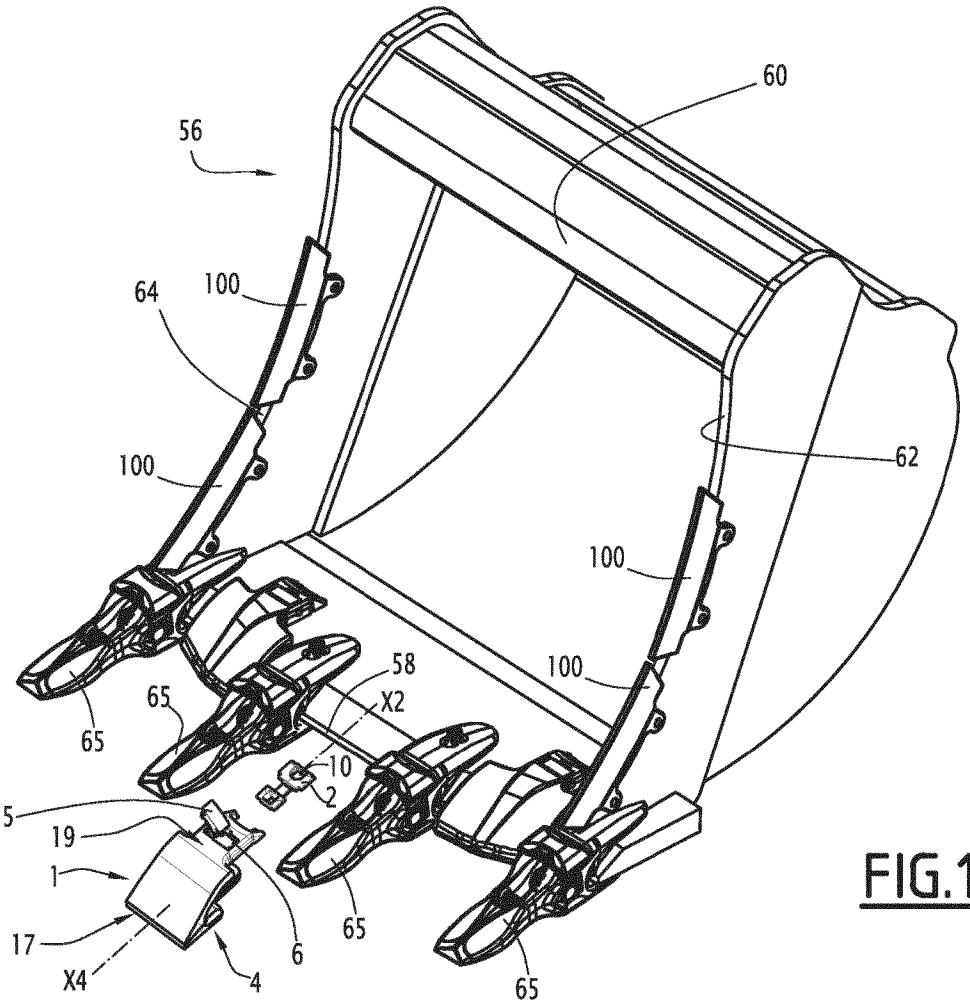
FIG. 15 shows a perspective view of a bucket equipped with protection systems according to the invention, wherein the that is located in the center of the bucket cutting blade is shown exploded.

Alternatively, other edges of the access opening of the bucket 56 may be protected by means of the protection system shown in the figures, in particular the upper blade 60 as well as the two lateral edges 62 and 64. In FIG. 15, the edges 60, 62 and 64 are protected by means of protection systems 100. These protection systems 100 may be replaced by a protection system according to the invention, which fits on these edges 60, 62 and 64.

The embodiments and alternatives contemplated above may be combined to generate new embodiments of the invention.

The invention claimed is:

1. A protection device of an edge of a bucket of a public work machine or an extraction machine, wherein the bucket comprises a sliding rail for receiving the protection device, and a retaining notch provided in the sliding rail, the protection device comprising:

a protection part of the edge, which is designed to be slipped on the sliding rail, sliding along a sliding axis, to a configuration of protection of the edge, wherein a window is arranged through the protection part so that the window opens into the retaining notch in the protection configuration; and a shim which is designed to be mounted within the window in order to be housed in the retaining notch in the protection configuration, in order to prevent the sliding of said protection part with respect to the sliding rail and thus to bind them together, wherein:

said protection part comprises at least one locking stop arranged at the periphery of the window, said at least one locking stop being distinct from the retaining notch; and the protection device further comprises a locking key that is movable relative to said shim about a pivot axis between a first angular position, in which assembly and disassembly of said shim in the window is allowed, and a second angular position in which said locking key abuts said at least one locking stop and thus prevents disassembly of said shim.

2. A protection device according to claim 1, wherein:

said locking key comprises a head projecting from said shim and in a first portion of which a passage slot is hollowed out, a second portion of the head forming an abutment finger, and said protection part comprises a receiving notch for said head when said shim is mounted within the window, the receiving notch extending from an entrance neck where a section of the receiving notch is reduced to form said locking stop, such that:

when said locking key is in its first angular position, the abutment finger is oriented to traverse the entrance neck during assembly or disassembly of said shim, and when said locking key is in its second angular position, the abutment finger abuts the entrance neck, which thus opposes disassembly of said shim.

3. A protection device according to claim 1, wherein:

said locking key comprises a lug which extends radially to the outside of said shim relative to the pivot axis, and said protection part comprises a radial abutment which forms said at least one locking stop, the radial abutment arranged in said protection part such that it extends radially with respect to said locking key when said shim is mounted, such that:

when said locking key is in the first angular position, said lug is spaced away from said radial abutment so that said shim may be freely disassembled, and when said locking key is in the second angular position, said lug abuts said radial abutment and thus opposes disassembly of said shim.

4. A protection device according to claim 3, wherein said radial abutment forms a snap-in notch of said lug, such that when said shim is mounted, pivoting of said locking key to the second angular position allows said lug to engage in the snap-in notch, while pivoting of said locking key to the first angular position allows said lug to be released from the snap-in notch.

5. A protection device according to claim 3, wherein said shim comprises a travel start abutment against which said lug abuts when said locking key is in its first angular position in order to limit an angular travel of said locking key to the first angular position.

6. A protection device according to claim 1, wherein:

said locking key comprises a substantially cylindrical clamping cam defining a cam axis which is parallel to the pivot axis but not coaxial with the latter, such that pivoting of said locking key from the first angular position to the second angular position causes an eccentric displacement of said cam about the pivot axis, and said protection part comprises a bearing surface extending in a plane substantially orthogonal to the sliding axis such that:

when said locking key is in its first angular position, said cam is spaced away from said bearing surface, and when said locking key is in its second angular position and when said shim is mounted, said cam bears against said bearing surface, wherein said shim is consequently pressed against the retaining notch in the direction of the sliding axis.

7. A protection device according to claim 1, wherein:

said locking key comprises a longitudinal body and a sheath made of a softer material than the longitudinal body in which the longitudinal body is integrally inserted in rotation, said shim comprises a bore coaxial with the pivot axis and in which said longitudinal body and said sheath may be inserted to form a pivot connection of said locking key relative to said shim about the pivot axis, and said sheath and said bore are adjusted to oppose the pivoting of said locking key relative to said shim about the pivot axis.

8. A protection device according to claim 7, wherein said sheath and said bore have a substantially cylindrical complementary shape, which is coaxial to the pivot axis in order to oppose pivoting of said locking key relative to said shim about the pivot axis.

9. A protection device according to claim 7, wherein said sheath is bonded to said longitudinal body.

10. A protection device according to claim 1, wherein:

said protection part comprises a retaining groove arranged at the periphery of the window opposite said at least one locking stop, and said shim comprises a retaining edge designed to be inserted into said retaining groove when said shim is mounted, so that when said locking key is in its second angular position, said shim is retained mounted within the window by said at least one locking stop and by said retaining groove.

11. A protection device according to claim 1, wherein:

said locking key comprises an interaction facility with a tool, so that said locking key may be pivoted about the pivot axis using the tool via the interaction facility, said protection part comprises an access opening for said interaction facility, and said locking key may be pivoted via said interaction facility using the tool from outside said protection part when said shim is mounted.

12. A protection device according to claim 8, wherein the cylindrical complementary shape has a polygonal shape.

13. A protection device according to claim 11, further comprising a means, of a cap or lid type, for closing said access opening.

14. A protection system, comprising:

a protection device of an edge of a bucket of a public works or extraction machine, wherein the bucket comprises a sliding rail for receiving the protection device, and a retaining notch provided in the sliding rail, the protection device comprising:

a protection part of the edge, which is designed to be slipped on the sliding rail, sliding along a sliding axis, to a configuration of protection of the edge, wherein a window is arranged through the protection part so that the window opens into the retaining notch in the protection configuration; and a shim which is designed to be mounted within the window in order to be housed in the retaining notch in the protection configuration, in order to prevent the sliding of said protection part with respect to the sliding rail and thus to bind them together, wherein:

said protection part comprises at least one locking stop arranged at the periphery of the window, said at least one locking stop being distinct from the retaining notch, and the protection device further comprises a locking key that is movable relative to said shim about a pivot axis between a first angular position, in which assembly and disassembly of said shim in the window is allowed, and a second angular position in which said locking key abuts said at least one locking stop and thus prevents disassembly of said shim; and the sliding rail for receiving said protection device, which is designed to be secured to the bucket, wherein a retaining notch of said protection device is formed in the sliding rail.

15. A method of protecting an edge of a bucket by means of the protection system of claim 14, the method comprising:

slipping the protection part on the sliding rail by sliding it along the sliding axis to the edge protection configuration;

mounting the shim within the window, wherein the locking key is in its first angular position; and rotating the locking key to its second angular position.

* * * * *